US012584195B2

(12) United States Patent
Kim et al.

(10) Patent No.: US 12,584,195 B2
(45) Date of Patent: Mar. 24, 2026

(54) PLATED STEEL MATERIAL HAVING EXCELLENT PROCESSABILITY AND CORROSION RESISTANCE

(71) Applicant: Hyundai Steel Company, Incheon (KR)

(72) Inventors: Seon Jin Kim, Ansan (KR); Jae Min Lee, Gimpo (KR)

(73) Assignee: Hyundai Steel Company, Incheon (KR)

( * ) Notice: Subject to any disclaimer, the term of this patent is extended or adjusted under 35 U.S.C. 154(b) by 0 days.

(21) Appl. No.: 18/576,034

(22) PCT Filed: Dec. 15, 2022

(86) PCT No.: PCT/KR2022/020446
§ 371 (c)(1),
(2) Date: Jan. 2, 2024

(87) PCT Pub. No.: WO2023/191248
PCT Pub. Date: Oct. 5, 2023

(65) Prior Publication Data

US 2024/0336995 A1 Oct. 10, 2024

(30) Foreign Application Priority Data

Mar. 31, 2022 (KR) ..... 10-2022-0040400

(51) Int. Cl.
*C22C 18/04* (2006.01)
*C23C 2/02* (2006.01)
(Continued)

(52) U.S. Cl.
CPC ..... *C22C 18/04* (2013.01); *C23C 2/0224* (2022.08); *C23C 2/06* (2013.01); *C23C 2/20* (2013.01); *C23C 2/29* (2022.08); *C23C 2/405* (2013.01)

(58) Field of Classification Search
None
See application file for complete search history.

(56) References Cited

U.S. PATENT DOCUMENTS 6,465,114 B1 * 10/2002 Honda ..... C23C 28/023 428/626
10,392,686 B2 8/2019 Shimoda et al.
(Continued)

FOREIGN PATENT DOCUMENTS

JP 2001355053 A * 12/2001
JP 2005-105367 A 4/2005
(Continued)

OTHER PUBLICATIONS

LeBozec, N., D. Thierry, D. Persson, C.K. Riener, G. Luckeneder, Influence of microstructure of zinc-aluminium-magnesium alloy coated steel on the corrosion behavior in outdoor marine atmosphere, Surface and Coatings Technology, vol. 374, 2019, pp. 897-909 (Year: 2019).*
(Continued)

*Primary Examiner* — Daniel J. Schleis
(74) *Attorney, Agent, or Firm* — Fox Rothschild LLP

(57) ABSTRACT

The present invention provides a plated steel material having excellent processability and corrosion resistance, the plated steel material comprising: a base iron; and a hot-dip alloy-plated layer formed on the base iron, the hot-dip alloy-plated layer comprising, in wt %, 5-30% of Al, 2-10% of Mg, and a balance of Zn and other inevitable impurities, wherein, in a cross-section in the hot-dip alloy-plated layer, the area fraction of a MgZn2 phase is 20-70%, and the ratio of the area fraction of an Al-containing phase to the area fraction of the MgZn2 phase is 1-70%.

6 Claims, 3 Drawing Sheets

(51) Int. Cl.

| | |
|---|---|
| ***C23C 2/06*** | (2006.01) |
| ***C23C 2/20*** | (2006.01) |
| ***C23C 2/28*** | (2006.01) |
| ***C23C 2/40*** | (2006.01) |

(56) References Cited

U.S. PATENT DOCUMENTS

| | | | | |
|---|---|---|---|---|
| 11,236,409 | B2 | 2/2022 | Mitsunobu | |
| 11,725,259 | B2 | 8/2023 | Mitsunobu et al. | |
| 2007/0029015 | A1 | 2/2007 | Yoshinaga et al. | |
| 2021/0381091 | A1 | 12/2021 | Kim et al. | |
| 2022/0152983 | A1 | 5/2022 | Mitsunobu et al. | |
| 2022/0341017 | A1 * | 10/2022 | Kim | B32B 15/043 |

FOREIGN PATENT DOCUMENTS

| | | | | |
|---|---|---|---|---|
| JP | 4555499 | B2 | 9/2010 | |
| JP | 6164391 | B1 | 7/2017 | |
| KR | 101376381 | B1 | 3/2014 | |
| KR | 10-2014-0074231 | A | 6/2014 | |
| KR | 10-2020-0076585 | A | 6/2020 | |
| KR | 20200136066 | A | 12/2020 | |
| KR | 10-2021-0035722 | A | 4/2021 | |
| KR | 10-2021-0127991 | A | 10/2021 | |
| WO | 2020/213680 | A1 | 10/2020 | |
| WO | 2020/213688 | A1 | 10/2020 | |
| WO | WO-2021060879 | A1 * | 4/2021 | C23C 2/06 |

OTHER PUBLICATIONS

Xu, Minyun, Dong Han, Zhaoyang Zheng, Ruina Ma, An Du, Yongzhe Fan, Xue Zhao, Xiaoming Cao, Effects of cooling rate on the microstructure and properties of hot-dipped Zn—Al—Mg coatings, Surface and Coatings Technology, vol. 444, 2022, 128665 (Year: 2022).*

Request for the Submission of an Opinion issued in KR application No. 10-2022-0040400 on Sep. 19, 2023.

International Search Report issued in PCT/KR2022/020446 on Jul. 11, 2023.

Office Action issued Jan. 24, 2025 in corresponding Japanese Patent Application No. 2023-572667.

Extended European Search Report dated Jun. 13, 2025, for corresponding European Patent Application No. 22935918.7.

Decision of Rejection dated Jul. 25, 2025, for corresponding Japanese Patent Application No. 2023-572667.

* cited by examiner

PLATED STEEL MATERIAL HAVING EXCELLENT PROCESSABILITY AND CORROSION RESISTANCE

CROSS-REFERENCES TO RELATED APPLICATIONS

This application is a 35 U.S.C. § 371 national phase entry of International Application No. PCT/KR2022/020446 filed Dec. 15, 2022, which claims priority from Korean Application No. 10-2022-0040400 filed on Mar. 31, 2022. The entire contents of these applications are incorporated herein by reference in their entirety.

TECHNICAL FIELD

The present disclosure relates to a steel material, and more specifically, to a plated steel material having excellent workability and corrosion resistance.

BACKGROUND ART

Hot-dip zinc-plated steel sheets have excellent sacrificial corrosion resistance, and when exposed to a corrosive environment, zinc with a low potential is preferentially eluted to prevent corrosion of a steel material. Due to such excellent corrosion characteristics, the hot-dip zinc-plated steel sheets have been used as steel sheets for home appliances, construction materials, and automobiles. However, as the expectation and demand for corrosion resistance increase due to technological development and improvement in quality level, the need for development of products having better corrosion resistance than the hot-dip zinc-plated steel sheets of the related art has been increasing. In order to address the above problem, since the early 2000s, highly corrosion-resistant plated steel sheets that improve corrosion resistance by adding aluminum (Al) and magnesium (Mg) to a zinc (Zn) plating bath have been produced in Europe and Japan. In addition to the sacrificial corrosion resistance of Zn, the highly corrosion-resistant plated steel sheet forms dense corrosion products in a corrosive environment as a result of the addition of Mg and Al to shield the steel material from an oxidizing atmosphere, thereby improving corrosion resistance. However, the Zn—Al—Mg plated steel sheet has excellent corrosion resistance, compared with the zinc-plated steel sheet, but has a disadvantage in that workability is deteriorated. The intermetallic compound of Zn—Al—Mg has high hardness and low crack resistance, and cracks cause problems of degrading appearance in a processing process or exposing the base steel material to lower corrosion resistance. As the related prior art, there is Japanese Patent Application Publication No. 2005-105367.

DETAILED DESCRIPTION

Technical Problem

A technical problem to be achieved by the present disclosure is to provide a plated steel material having excellent workability and corrosion resistance.

Technical Solution

A plated steel material having excellent workability and corrosion resistance according to an aspect of the present disclosure for addressing the above problems includes a base steel; and a hot-dip alloy-plated layer formed on the base steel, wherein the hot-dip alloy-plated layer includes, by wt. %, 5% to 30% of Al, 2% to 10% of Mg, a balance of Zn and inevitable impurities. An area fraction of a $MgZn_2$ phase in a section in the hot-dip alloy-plated layer is 20 to 70%, and a ratio of an area fraction of an Al-containing phase to the area fraction of the $MgZn_2$ phase in the section in the hot-dip alloy-plated layer is 1 to 70%.

A plated steel material having excellent workability and corrosion resistance according to another aspect of the present disclosure for solving the above problems includes a base steel; and a hot-dip alloy-plated layer formed on the base steel, wherein the hot-dip alloy-plated layer includes, by wt. %, 5% to 30% of Al, 2% to 10% of Mg, a balance of Zn and inevitable impurities. An area fraction of a $MgZn_2$ phase where a ratio of an average minor axis length (a) to an average major axis length (b) is 0.5 or less in the entire $MgZn_2$ phase on a surface of the hot-dip alloy-plated layer is 70% or less.

In the plated steel material, in the $MgZn_2$ phase whose ratio of the average minor axis length (a) to the average major axis length (b) is 0.5 or less, the ratio of the average minor axis length (a) to the average major axis length (b) may be 1/10 or greater and 1/2 or less.

In the plated steel material as described herein, the average minor axis length (a) may be 1 to 20 μm, and the average major axis length (b) may be 2 to 200 μm.

In the plated steel material as described herein, on the surface of the hot-dip alloy-plated layer, an area fraction of Al—Zn dendrites constituted by an Al phase and a Zn phase may be 30% or less.

In the plated steel material as described herein, an area fraction of a $MgZn_2$ phase whose ratio of the average minor axis length (a) to the average major axis length (b) is greater than 0.5 in the whole $MgZn_2$ phase on the surface of the hot-dip alloy-plated layer may be 30% or greater.

In the plated steel material as described herein, a diameter of an imaginary circle having the same area as a cross-sectional area of the $MgZn_2$ phase whose ratio of the average minor axis length (a) to the average major axis length (b) is greater than 0.5 may be 1 to 50 μm.

In the plated steel material as described herein, the hot-dip alloy-plated layer may further include, by wt. %, 0.05% to 10% of Fe, and greater than 0 and less than 1% of Si.

Advantageous Effects

According to the embodiment of the present disclosure, it is possible to implement a plated steel material having excellent workability and corrosion resistance.

It should be noted that the scope of the present disclosure is not limited by these effects.

BEST MODE

Figure 1:
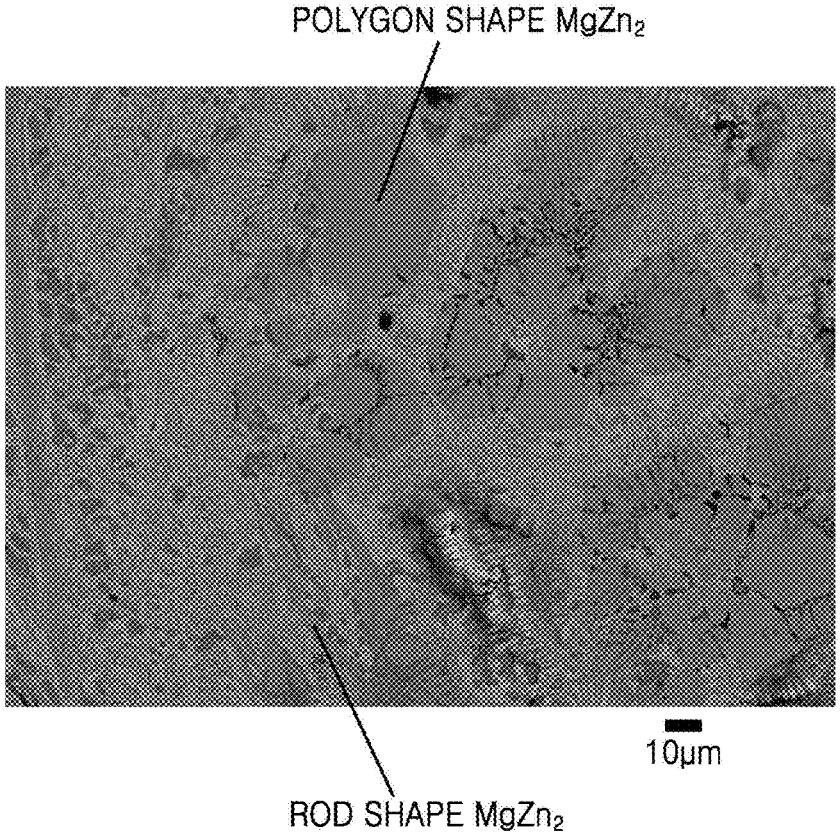
FIG. 1 is a photograph of a surface of a hot-dip alloy-plated layer according to Example 2 in a first Experimental Example.

A plated steel material having excellent workability and corrosion resistance according to an embodiment of the present disclosure will be described in detail. The terms used herein are terms appropriately selected in consideration of the functions in the present disclosure. Accordingly, the definitions of the terms should be made based on the contents throughout the present specification. Hereinafter, specific details of an ultra-high-strength, high-corrosion-resistant plated steel sheet having excellent elongation and a manufacturing method thereof will be provided.

As described above, the Zn—Al—Mg plated steel sheet has excellent corrosion resistance, compared with the zinc-plated steel sheet, but has a disadvantage in that workability is deteriorated. The intermetallic compound of Zn—Al—Mg has high hardness and low crack resistance, and cracks cause problems of degrading appearance during processing or exposing the base steel material to lower corrosion resistance during processing. $MgZn_2$ of intermetallic compounds has the highest hardness, and therefore, the technology of suppressing a shape and a size of the $MgZn_2$ phase is important.

The present disclosure aims to provide a Zn—Al—Mg-based high corrosion-resistant plated steel material including, by wt. %, 5% to 30% of Al, 2% to 10% of Mg, a balance of Zn and inevitable impurities, and to control the microstructure of the $MgZn_2$ phase with high hardness for improving workability and processing corrosion resistance.

A plated steel material having excellent workability and corrosion resistance according to an embodiment of the present disclosure includes a base steel; and a hot-dip alloy-plated layer formed on the base steel, wherein the hot-dip alloy-plated layer includes, by wt. %, 5% to 30% of Al, 2% to 10% of Mg, a balance of Zn and inevitable impurities. Furthermore, the hot-dip alloy-plated layer may further include, by wt. %, 0.05% to 10% of Fe and greater than 0 and less than 1% of Si.

The zinc alloy-plated layer of the present disclosure may be constituted by a primary crystal Al phase (Al single-phase structure with Zn solid-solution), a Zn solid-solution phase, $MgZn_2$ (including Al-including $MgZn_2$ phase, and $Mg_2Zn_{11}$ phase), and an Al/Zn/Mg eutectic structure. The $MgZn_2$ phase and the Al-including $MgZn_2$ phase on a surface of the Zn—Al—Mg-based plated layer may have a polygonal shape, and a rod and acicular shape, in terms of microstructure for improving workability and processing corrosion resistance.

The zinc alloy-plated layer may include, by wt. %, 5% to 30% of Al, 2% to 10% of Mg, a balance of Zn and inevitable impurities. Mg and Al in the plated layer are ones of elements that improve corrosion resistance, and improve corrosion resistance by forming a corrosion product more densely. If Mg is less than 1.0 wt. %, the contribution to corrosion resistance is insignificant, and in the related art, Mg is used in an amount of less than 2.0 wt. % because of difficulty in production due to Mg oxide dross when the amount is greater than 2.0 wt. %. However, in the present disclosure, Mg is added in an amount of 2.0 wt. % or greater in order to achieve better corrosion resistance. As described above, when Mg is added in an amount greater than 2.0 wt. %, there is difficulty in production due to oxide dross. However, when Al is added in an amount of 5.0 wt. % or greater, dross caused by Mg oxidation in the molten metal can be reduced. In addition, when Al is added, it can play a role of improving corrosion resistance by forming primary crystal Al and a ternary eutectic phase of Zn—Al—Mg. On the other hand, if Mg is added in an amount greater than 10.0 wt. %, the above-described rod-shaped and acicular $MgZn_2$ or Al-including $MgZn_2$ phase grows in greater than of 70% of an area fraction of the whole $MgZn_2$, and therefore, the workability of the plated layer is deteriorated, and cracks are generated in the plated layer during processing, thereby exposing the steel material or the Fe—Al—Zn interface alloying layer to lower the corrosion resistance. On the other hand, if Al is added in an amount greater than 30 wt. %, the discontinuous Fe—Al—Zn interface alloy layer between the steel material and the plated layer grows excessively due to rising melting point of a plating bath, resulting in poor interface adhesiveness during processing.

An exemplary process of forming a hot-dip alloy-plated layer on the base steel in the present disclosure is as follows.

First, the base steel annealed at 680 to 850° C. is immersed in a plating bath of 440 to 530° C. and is passed through an air knife to satisfy 30 to 300 g/m$^2$ based on one side of the base steel. However, an entry temperature of the base steel after annealing is controlled so that there is no difference of ±20° C. or greater from the plating bath temperature.

A shape and a fraction of the $MgZn_2$ phase can be closely controlled through cooling. After immersion in the plating bath, the base steel is cooled at a cooling rate of 3 to 30° C./s up to a section where it is cooled to 200° C., so that a shape of a phase to be generated during solidification of the plated layer can be controlled. More preferably, the base steel can be cooled at a cooling rate of 5 to 20° C./s. If the cooling rate is less than 5° C./s, the primary crystal $MgZn_2$ phase grows coarsely to deteriorate workability, and the plated layer in a liquid state may react with oxygen to act as a factor that impairs the appearance of the plated surface. On the other hand, when the cooling is performed at a cooling rate greater than of 30° C./s, the plated layer is not uniformly formed due to non-uniform solidification, and productivity is lowered due to vibration of the sheet.

In the plated steel material according to an aspect of the present disclosure, an area fraction of a $MgZn_2$ phase in a section (for example, longitudinal section) of the hot-dip alloy-plated layer is 20 to 70%, and a ratio of an area fraction of an Al-containing phase to the area fraction of the $MgZn_2$ phase in the section (for example, longitudinal section) of the hot-dip alloy-plated layer is 1 to 70%. Here, the Al-containing phase may be present apart from the $MgZn_2$ phase or within the $MgZn_2$ phase in the section in the hot-dip alloy-plated layer. In addition, in the present embodiment, the Al-containing phase means i) an Al single phase, and ii) a phase that contains 20% or greater of Al, but includes less than 2% of inevitable impurities and a balance of Zn.

For example, the hot-dip alloy-plated layer includes, by area fraction, 20 to 70% of the $MgZn_2$ phase in the section. That is, a ratio of a cross-sectional area (A2) occupied by the $MgZn_2$ phase in a total cross-sectional area (A1) of the hot-dip alloy-plated layer is 20 to 70%, and a value of $(A2/A1)\times100$ satisfies a range of 10 to 60. On the other hand, in the section of the hot-dip alloy-plated layer, a sum of a cross-sectional area (B1) of the Al-containing phase present apart from the $MgZn_2$ phase and a cross-sectional areas (B2) of the Al-containing phase present within the $MgZn_2$ phase has a ratio of 1 to 70%, compared to a cross-sectional area (B3) of the whole $MgZn_2$ phase. That is, a value of $[(B1+B2)/B3]\times100$ satisfies a range of 1 to 70. According to this structure, crack resistance is excellent, and specifically, in bending evaluation (3 T bending evaluation, 1 T bending evaluation), an average crack width may be 30 μm or less.

On the surface of the hot-dip alloy-plated layer of the plated steel material of the present disclosure, the area fraction of the $MgZn_2$ phase may be 10 to 70%, and if the area fraction is less than 10%, the formation thereof is impossible, and if the area fraction is greater than 70%, crack resistance is reduced. Here, the surface of the hot-dip alloy-plated layer may mean an upper surface in contact with an outside.

In the plated steel material according to another aspect of the present disclosure, an area fraction of a $MgZn_2$ phase whose ratio of an average minor axis length (a) to an average major axis length (b) is 0.5 or less in the whole $MgZn_2$ phase on the surface of the hot-dip alloy-plated layer of the plated steel material may be 70% or less. For example, 70% or less of the $MgZn_2$ phase of the whole $MgZn_2$ phase on the surface of the hot-dip alloy-plated layer may have a ratio of the average minor axis length (a) to the average major axis length (b) of 1:2 to 1:10, i.e., a value of 0.5 or less. In this case, the $MgZn_2$ phase whose ratio of the average minor axis length (a) to the average major axis length (b) is 0.5 or less may have the ratio of the average minor axis length (a) to the average major axis length (b) of 1/10 or greater and 1/2 or less. If the ratio of the average minor axis length (a) to the average major axis length (b) is less than 0.5, crack resistance is reduced. The average minor axis length (a) may be 1 to 20 μm, and the average major axis length (b) may be 2 to 200 μm. An average minor axis length (a) of less than 1 μm and an average major axis length (b) of less than 2 μm cannot be formed, and if the average minor axis length (a) exceeds 20 μm or the average major axis length (b) exceeds 200 μm, crack resistance is lowered.

Meanwhile, on the surface of the hot-dip alloy-plated layer of the plated steel material according to another aspect of the present disclosure, an area fraction of Al—Zn dendrites constituted by an Al phase and a Zn phase may be 30% or less. Al—Zn dendrites preferably have a low area fraction because they do not favorably affect chemical conversion treatment properties or liquid metal embrittlement (LME) resistance. Therefore, in the plated layer according to the present embodiment, the area fraction of Al—Zn dendrites is set to 30% or less.

As described above, in the plated steel material having excellent workability and corrosion resistance according to an embodiment of the present disclosure, the $MgZn_2$ phase and the Al-including $MgZn_2$ phase on the surface of the Zn—Al—Mg-based plated layer have the polygonal shape, and the rod and acicular shape, and a ratio of an average minor axis length (a) to an average major axis length (b) of the rod- and acicular shape is $1:2 \leq a:b \leq 1:10$. The rod-shaped and acicular $MgZn_2$ phase of the whole $MgZn_2$ is distributed on the surface in an area fraction of 70% or less, and more preferably, in an area fraction of less than 50%, and the remainder $MgZn_2$ is distributed in the polygonal shape.

An area fraction of a $MgZn_2$ phase whose ratio of the average minor axis length (a) to the average major axis length (b) is greater than 0.5 in the whole $MgZn_2$ phase on the surface of the hot-dip alloy-plated layer is 30% or greater. For example, 30% or greater of the $MgZn_2$ phase in the whole $MgZn_2$ phase on the surface of the hot-dip alloy-plated layer has a ratio of the average minor axis length (a) to the average major axis length (b) greater than 0.5, such as 1:1.5 or 1:1.2. A diameter (average diameter) of an imaginary circle having the same area as a cross-sectional area of the $MgZn_2$ phase whose ratio of the average minor axis length (a) to the average major axis length (b) is greater than 0.5 may be 1 to 50 μm. If the average diameter is less than 1 μm, the formation thereof is impossible, and if the average diameter is greater than 50 μm, crack resistance is reduced.

Hereinafter, preferred Experimental Examples are presented for better understanding of the present disclosure. However, the following Experimental Examples are only for helping to understand of the present disclosure, and the present disclosure is not limited by the following Experimental Examples.

First Experimental Example

1. Specimen Composition and Processing Conditions

A 1.2 mm cold-rolled material was prepared as a base steel sheet, and had the components (composition) of 0.15 wt. % of carbon (C), 0.01 wt. % of silicon (Si), 0.6 wt. % of manganese (Mn), 0.05 wt. % of phosphorus (P), 0.05 wt. % of sulfur(S) and the remainder of iron (Fe). After annealing at a temperature of 760° C. in a nitrogen-5 to 10% hydrogen atmosphere gas, the annealed specimen was cooled to a temperature that was not different greater than 20° C. from the plating bath, and then immersed in the plating bath for 1 to 5 seconds. After immersion in the plating bath of a temperature of 485° C., the plating thickness was adjusted to about 20 μm by nitrogen wiping, and cooled at a cooling rate of 7° C./s to obtain a Zn—Al—Mg-based plated steel sheet. The composition of the plating bath satisfies a range of, by wt. %, 5% to 30% of Al, 2% to 10% of Mg, and a balance of Zn.

2. Plated Layer Composition and Microstructure Evaluation

Table 1 shows the composition of the hot-dip alloy-plated layer in the plated steel material according to a first Experimental Example of the present disclosure (unit: wt. %) and evaluation results of the microstructure.

TABLE 1

| Classification | Zn | Al | Mg | Rod/Acicular $MgZn_2$ area (%) | Interface alloy layer thickness (μm) |
|---|---|---|---|---|---|
| Example 1 | Bal. | 10 | 3.2 | 20 | 1.12 |
| Example 2 | Bal. | 10 | 5 | 38 | 0.65 |
| Example 3 | Bal. | 15 | 5 | 42 | 1.58 |

For each manufactured plated steel sheet, the rod-shaped and acicular $MgZn_2$ area was measured using an image program after observing the surface at 500-times with FE-SEM. The thickness of the interface alloy layer was measured by 1000-times magnifying the section.

Referring to Examples 1 to 3 of Table 1, it can be confirmed that the area ratio of the rod-shaped and acicular $MgZn_2$ was less than 50% and the workability was excellent. In Comparative Example to the Examples, the inventors confirmed that the area of rod-shaped and acicular $MgZn_2$ phase increased sharply, and confirmed that the workability was deteriorated as a result of formation of the interface alloy layer in excess of 10 μm due to the temperature rising of the plating bath.

FIG. 1 is a photograph of the surface of the hot-dip alloy-plated layer according to Example 2 in the first Experimental Example. Referring to FIG. 1, it can be confirmed that $MgZn_2$ phase appearing in the rod and acicular shape on the surface of the Zn—Al—Mg-based plated layer satisfied the range of $1:2 \leq a:b \leq 1:10$ of the ratio of the average minor axis length (a) to the average major axis length (b). In addition, it can be confirmed that the rod-shaped and acicular $MgZn_2$ phase of the whole $MgZn_2$ was distributed on the surface in the area fraction of 70% or less.

Figure 2:
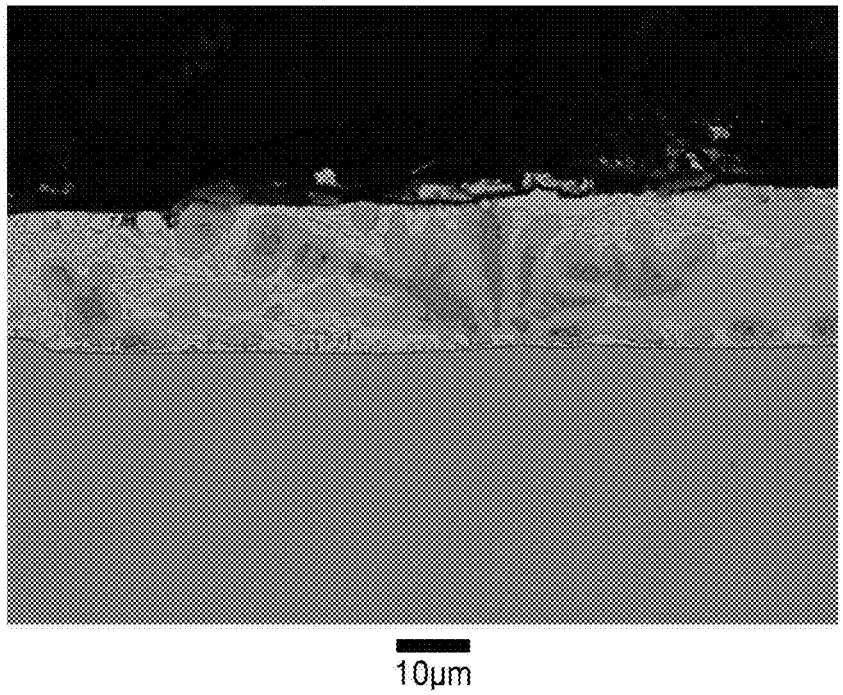
FIG. 2 is a 1000-times magnified FE-SEM photograph of a section of the hot-dip alloy-plated layer according to Example 2 in the first Experimental Example.

FIG. 2 is a 1000-times magnified FE-SEM photograph of a section of the hot-dip alloy-plated layer according to Example 2 in the first Experimental Example. Referring to FIG. 2, it can be confirmed that the growth of the Fe—Al interface alloy layer in the hot-dip alloy-plated layer according to Example 2 was 10 μm or less.

3. Bending Workability Evaluation

Table 2 shows bending workability evaluation results for the plated steel materials according to the first Experimental Example of the present disclosure. After 3 T bending and 1 T bending, the bending processed part was observed at 200 times and 500 times with a Field Emission Scanning Electron Microscope (FE-SEM), and then, the widths of the bending cracks were measured and averaged for evaluation. In 3 T (crack width) and 1 T (crack width), 'O' means that the average crack width in the bending evaluation was 15 μm or less, '(' means that the average crack width in the bending evaluation was greater than 15 μm and 30 μm or less, and 'A' means that the average crack width in the bending evaluation was greater than 30 μm and 40 μm or less.

In addition, after 3 T bending and 1 T bending, the bending processed part was observed at 100 times with the FE-SEM (Field Emission Scanning Electron Microscope), and then, the crack area fraction was calculated and evaluated using an image program. In 3 T (crack area fraction) and 1 T (crack area fraction), '◎' means that the crack area fraction in the bending evaluation was 30% or less, '○' means that the crack area fraction in the bending evaluation was greater than 30% and 50% or less, and 'Δ' means that the crack area fraction in the bending evaluation was greater than 50% and 70% or less.

TABLE 2

| Classification | Zn | Al | Mg | 3T (Crack width) | 1T (Crack width) | 3T (Crack area fraction) | 1T (Crack area fraction) |
|---|---|---|---|---|---|---|---|
| Example 1 | Bal. | 10 | 3.2 | ◎ | ○ | ◎ | Δ |
| Example 2 | Bal. | 10 | 5 | ◎ | Δ | ◎ | Δ |
| Example 3 | Bal. | 15 | 5 | ○ | Δ | ○ | Δ |

Figure 3:
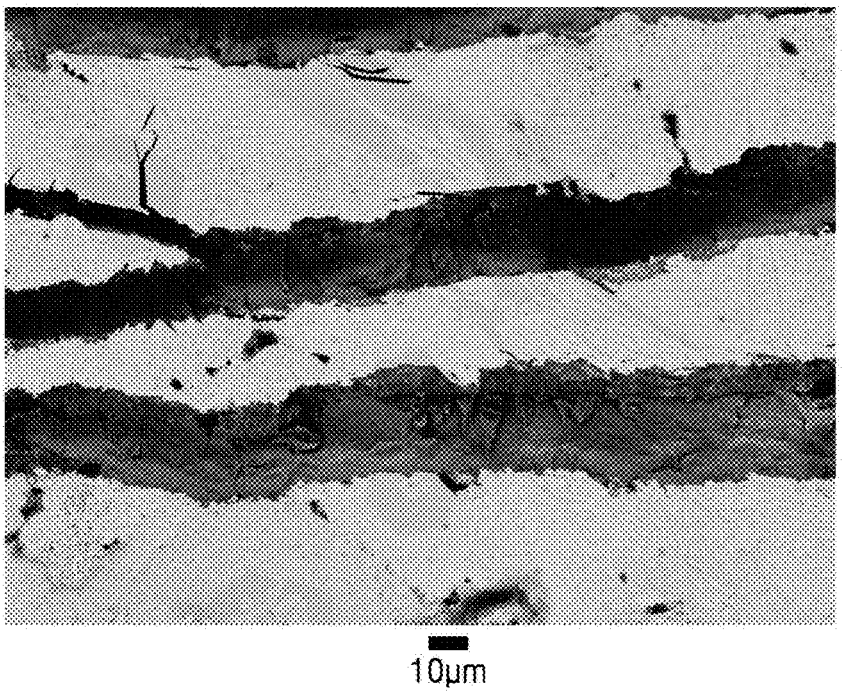
FIG. 3 is a 500-times magnified FE-SEM photograph of a processed part after evaluating 1 T bending workability for the hot-dip alloy-plated layer according to Example 2 in the first Experimental Example.

Referring to Examples 1 to 3 in Table 2, it can be confirmed that the formation of rod-shaped and acicular $MgZn_2$ was relatively under developed, and the widths of the cracks were less than 40 μm. As Comparative Example in comparison to the Examples, the inventors confirmed that when the area fraction of the rod-shaped and acicular $MgZn_2$ was greater than 70%, cracks progressed within $MgZn_2$ phase having high hardness and along the grain boundaries and the widths of the cracks was greater than 40 μm on average. In addition, as Comparative Example in comparison to the Examples, the inventors confirmed that when the $MgZn_2$ phase developed in a rod shape, not only the widths of cracks but also the frequency of cracks increased, and therefore, the area of cracks was greater than 70% and the deterioration was caused. FIG. 3 is a 500-times magnified FE-SEM photograph of a processed part after evaluating 1 T bending workability for the hot-dip alloy-plated layer according to Example 2 in the first Experimental Example. Referring to FIG. 3, it can be confirmed that the formation of rod-shaped and acicular $MgZn_2$ was relatively under developed in the hot-dip alloy-plated layer according to Example 2, the widths of the cracks were less than 40 μm, and the area fraction of the rod-shaped and acicular $MgZn_2$ was 70% or less.

According to the results of the first Experimental Example described above, it can be confirmed that even when $MgZn_2$ phase with high hardness, which is unfavorable to workability, is formed, a plated steel sheet having excellent workability can be implemented by suppressing the growth of the rod-shaped and acicular $MgZn_2$ phase and controlling the area fraction thereof.

Second Experimental Example

1. Specimen Composition and Processing Conditions

A 1.2 mm cold-rolled material was prepared as a base steel sheet, and had the components (composition) of 0.15 wt. % of carbon (C), 0.01 wt. % of silicon (Si), 0.6 wt. % of manganese (Mn), 0.05 wt. % of phosphorus (P), 0.05 wt. % of sulfur(S) and the remainder of iron (Fe). After annealing at a temperature of 760° C. in a nitrogen-5 to 10% hydrogen atmosphere gas, the annealed specimen was cooled to a temperature that was not different greater than 20° C. from the plating bath, and then immersed in the plating bath for 1 to 5 seconds. After immersion in the plating bath of a temperature of 485° C., the plating thickness was adjusted to about 20 μm by nitrogen wiping, and cooled at a cooling rate of 7° C./s to obtain a Zn—Al—Mg-based plated steel sheet. The composition of the plating bath satisfies a range of, by wt. %, 5% to 30% of Al, 2% to 10% of Mg, and a balance of Zn. The hot-dip alloy-plated layer includes 5 wt. % or greater and 30 wt. % or less of Al, 2 wt. % or greater and 10 wt. % or less of Mg, 0.05 wt. % or greater and 10 wt. % or less of Fe, greater than 0 wt. % and less than 1 wt. % of Si, a balance of Zn, and other components diffused from the base steel.

2. Microstructure of Section of Plated Layer and Bending Workability Evaluation

Table 3 shows bending workability evaluation results according to the $MgZn_2$ phase area fraction (%) in the section of the hot-dip alloy plated layer and the ratio (%) of Al single phase area to the $MgZn_2$ phase area fraction in the section of the hot-dip alloy plated layer in the plated steel material according to the second Experimental Example of the present disclosure. In Table 3, after 3 T bending, the bending processed part was observed at 200 times and 500 times with a Field Emission Scanning Electron Microscope (FE-SEM), and then, the widths of the bending cracks were measured and averaged for bending workability evaluation. '○' means that the average crack width in the bending evaluation was greater than 0 and 30 μm or less, and 'X' means that the average crack width in the bending evaluation was greater than 30 μm.

TABLE 3

| Specimens | $MgZn_2$ area fraction (%) in section of plated layer | Ratio (%) of Al single phase area to $MgZn_2$ area in section of plated layer | Bending workability evaluation |
|---|---|---|---|
| 1 | 60 | 20 | ○ |
| 2 | 58 | 68 | ○ |
| 3 | 31 | 70 | ○ |
| 4 | 23 | 11 | ○ |
| 5 | 62 | 18 | X |
| 6 | 58 | 71 | X |
| 7 | 20 | 72 | X |
| 8 | 24 | 75 | X |

Referring to Table 3, it can be confirmed that in the cases of specimens 1, 2, 3, and 4, the area fraction of $MgZn_2$ phase in the section of the hot-dip alloy-plated layer satisfied the range of 20 to 70%, at the same time, the ratio of the area fraction of the Al-containing phase to the area fraction of the $MgZn_2$ phase satisfied the range of 1 to 70%, and the average crack width in the bending processed part after 3 T bending was 30 μm or less.

In contrast, it can be confirmed that in the case of specimen 5, the area fraction of the $MgZn_2$ phase in the section of the hot-dip alloy-plated layer did not satisfy the range of 20 to 70%, and in the cases of specimens 6, 7, and 8, the ratio of the area fraction of the Al-containing phase to the area fraction of the $MgZn_2$ phase in the section of the hot-dip alloy-plated layer did not satisfy the range of 1 to 70%, and in this case, the average crack width in the bending processed part after T bending was greater than 30 μm.

TABLE 4

| Specimens | CASE1 Area fraction (%) | CASE2 Area fraction (%) | CASE2 Ratio of average minor axis length (a) to average major axis length (b) | CASE2 Average minor axis length (μm) | CASE2 Average major axis length (μm) | Bending workability evaluation |
|---|---|---|---|---|---|---|
| present embodiment | 30% or more | 70% or less | 1:2 to 1:10 | 1 to 20 | 2 to 200 | 30 or less |
| A1 | 70 | 30 | 1:2 | 10.2 | 20.0 | ◎ |
| A2 | 62 | 38 | 1:9.5 | 10.3 | 97.9 | ◎ |
| A3 | 68 | 32 | 1:10.2 | 4.0 | 40.8 | ○ |
| A4 | 66 | 34 | 1:9.1 | 20.5 | 84.1 | ○ |
| A5 | 62 | 38 | 1:8.9 | 29.1 | 200.8 | ○ |
| B1 | 59 | 41 | 1:10 | 5.2 | 52.0 | ◎ |
| B2 | 51 | 49 | 1:2.1 | 8.8 | 18.5 | ◎ |
| B3 | 52 | 48 | 1:10.1 | 4.8 | 48.5 | ○ |
| B4 | 55 | 45 | 1:2.3 | 20.1 | 197.0 | ○ |
| B5 | 57 | 43 | 1:9.8 | 20.5 | 200.5 | ○ |
| C1 | 39 | 61 | 1:10 | 20.0 | 200.0 | ◎ |
| C2 | 30 | 70 | 1:2.1 | 18.7 | 39.3 | ◎ |
| C3 | 31 | 69 | 1:10.2 | 2.2 | 22.4 | ○ |
| C4 | 39 | 61 | 1:4.1 | 20.3 | 83.2 | ○ |
| C5 | 35 | 65 | 1:6.9 | 29.0 | 200.1 | ○ |
| D1 | 27 | 73 | 1:2 | 3.0 | 6.0 | ○ |
| D2 | 29 | 71 | 1:2 | 18.0 | 36.0 | ○ |
| D3 | 25 | 75 | 1:5 | 10.8 | 54.0 | ○ |
| D4 | 29 | 71 | 1:9.5 | 2.0 | 19.0 | ○ |
| D5 | 28 | 72 | 1:10.2 | 2.0 | 20.4 | ○ |

Table 4 shows the bending workability evaluation results according to the $MgZn_2$ phase area fraction (%) and the ratio of the average minor axis length (a) to the average major axis length (b) on the surface of the hot-dip alloy plated layer in the plated steel material according to the second Experimental Example of the present disclosure. CASE1 relates to $MgZn_2$ whose ratio of the average minor axis length (a) to the average major axis length (b) is greater than 0.5, in the whole $MgZn_2$ on the surface of the plated layer, and CASE2 relates to $MgZn_2$ whose ratio of the average minor axis length (a) to the average major axis length (b) is 0.5 or less, in the whole $MgZn_2$ on the surface of the plated layer. In Table 4, the bending workability evaluation was performed for the plated steel sheet in which the area fraction of $MgZn_2$ in the section of the plated layer is 20 to 70%, and the Al-containing phase present within the $MgZn_2$ phase or present apart from the $MgZn_2$ phase is present in a ratio of 1 to 70%, compared to the cross-sectional area of the $MgZn_2$ phase. For the bending workability evaluation, after 3 T bending, the bending processed part was observed at 200 times and 500 times with a Field Emission Scanning Electron Microscope (FE-SEM), and then the widths of the bending cracks were measured and averaged. '◎' means that the average crack width in the 3 T bending evaluation was greater than 0 and 15 μm or less, and '○' means the average crack width in the 3 T bending evaluation was greater than 15 μm and 30 μm or less.

Referring to Table 4, it can be confirmed that specimens A1, A2, B1, B2, C1, and C2 satisfied all the cases where the area fraction of the $MgZn_2$ phase whose ratio of the average minor axis length (a) to the average major axis length (b) is greater than 0.5 in the whole $MgZn_2$ phase on the surface of the hot-dip alloy-plated layer is 30% or greater, where the area fraction of the $MgZn_2$ phase whose ratio of the average minor axis length (a) to the average major axis length (b) is 0.5 or less in the whole $MgZn_2$ phase on the surface of the hot-dip alloy-plated layer is 70% or less, where the ratio of the average minor axis length (a) to the average major axis length (b) is 1/10 or greater and 1/2 or less in the whole $MgZn_2$ phase on the surface of the hot-dip alloy-plated layer, where the average minor axis length (a) is 1 to 20 μm and where the average major axis length (b) is 2 to 200 μm, and in this case, that the average crack width in the 3 T bending evaluation was 15 μm or less.

In contrast, it can be confirmed that specimens D1, D2, D3, D4, and D5 did not satisfy the range in which the area fraction of the $MgZn_2$ phase whose ratio of the average minor axis length (a) to the average major axis length (b) is greater than 0.5 in the whole $MgZn_2$ phase on the surface of the hot-dip alloy-plated layer is 30% or greater, and the range in which the area fraction of the $MgZn_2$ phase whose ratio of the average minor axis length (a) to the average major axis length (b) is 0.5 or less in the whole $MgZn_2$ phase on the surface of the hot-dip alloy-plated layer is 70% or less, and in this case, that the average crack width in the 3 T bending evaluation was greater than 15 μm.

In addition, it can be confirmed that specimens A3, B3, C3, and D5 did not satisfy the range in which the ratio of the average minor axis length (a) to the average major axis length (b) is 1/10 or greater and 1/2 or less in the whole $MgZn_2$ phase on the surface of the hot-dip alloy-plated layer, and in this case, that the average crack width in the 3 T bending evaluation was greater than 15 μm.

Further, it can be confirmed that specimens A4, B4, and C4 did not satisfy the range in which the average minor axis length (a) is 1 to 20 μm, although they satisfied the ranges in which the area fraction of the $MgZn_2$ phase whose ratio of the average minor axis length (a) to the average major axis length (b) is 0.5 or less in the whole $MgZn_2$ phase on the surface of the hot-dip alloy-plated layer is 70% or less and in which the ratio of the average minor axis length (a) to the average major axis length (b) is 1/10 or greater and 1/2 or less in the whole $MgZn_2$ phase on the surface of the hot-dip alloy-plated layer, and in this case, that the average crack width in the 3 T bending evaluation was greater than 15 μm.

Further, it can be confirmed that specimens A5, B5, and C5 did not satisfy the range in which the average major axis length (b) is 2 to 200 μm, although they satisfied the ranges in which the area fraction of the $MgZn_2$ phase whose ratio of the average minor axis length (a) to the average major axis length (b) is 0.5 or less in the whole $MgZn_2$ phase on the surface of the hot-dip alloy-plated layer is 70% or less and in which the ratio of the average minor axis length (a) to the average major axis length (b) is 1/10 or greater and 1/2 or less in the whole $MgZn_2$ phase on the surface of the hot-dip alloy-plated layer, and in this case, that the average crack width in the 3 T bending evaluation was greater than 15 μm.

While the embodiments of the present disclosure have been described, various changes or modifications can be made by one skilled in the art. Such changes and modifications fall within the present disclosure as long as they do not depart from the scope of the present disclosure. Therefore, the scope of the present disclosure should be determined by the claims described below.

The invention claimed is:

1. A plated steel material having excellent workability and corrosion resistance, comprising:

a base steel; and a hot-dip alloy-plated layer formed on the base steel, wherein the hot-dip alloy-plated layer consists of, by wt. %, 5% to 30% of Al, 2% to 10% of Mg, a balance of Zn and inevitable impurities, and wherein an area fraction of a $MgZn_2$ phase where a ratio of an average minor axis length (a) to an average major axis length (b) is 0.5 or less in the entire $MgZn_2$ phase on a surface of the hot-dip alloy-plated layer is 70% or less.

2. The plated steel material according to claim 1, wherein in the $MgZn_2$ phase whose ratio of the average minor axis length (a) to the average major axis length (b) is 0.5 or less, the ratio of the average minor axis length (a) to the average major axis length (b) is 1/10 or greater and 1/2 or less.

3. The plated steel material according to claim 2, wherein the average minor axis length (a) is 1 to 20 μm, and the average major axis length (b) is 2 to 200 μm, and wherein after 3 T bending, an average crack width in said hot-dip alloy-plated layer is 15 μm or less.

4. The plated steel material according to claim 1, wherein on the surface of the hot-dip alloy-plated layer, an area fraction of Al—Zn dendrites constituted by an Al phase and a Zn phase is 30% or less.

5. The plated steel material according to claim 1, wherein an area fraction of a $MgZn_2$ phase whose ratio of the average minor axis length (a) to the average major axis length (b) is greater than 0.5 in the whole MgZn2 phase on the surface of the hot-dip alloy-plated layer is 30% or greater.

6. The plated steel material according to claim 5, wherein a diameter of an imaginary circle having the same area as a cross-sectional area of the MgZn2 phase where the ratio of the average minor axis length (a) to the average major axis length (b) is greater than 0.5 is 1 to 50 μm.

* * * * *